United States Patent [19]

Dickson et al.

[11] Patent Number: 4,513,020

[45] Date of Patent: Apr. 23, 1985

[54] PLATELET METAL POWDER FOR COATING A SUBSTRATE

[75] Inventors: James Dickson, Stirling, N.J.; Charles Hays, Pearland, Tex.

[73] Assignee: Allied Corporation, Morris Township, N.J.

[21] Appl. No.: 483,330

[22] Filed: Apr. 8, 1983

Related U.S. Application Data

[62] Division of Ser. No. 285,885, Jul. 22, 1981, abandoned.

[51] Int. Cl.[3] ..... B05D 1/00; B22F 1/00

[52] U.S. Cl. ..... 427/34; 75/0.5 AA; 75/0.5 BA; 75/251

[58] Field of Search ..... 75/251–255, 75/0.5 A, 0.5 AA, 0.5 AC, 0.5 B, 0.5 BA, 0.5 BL, 0.5 C, 123 B, 170; 427/34

[56] References Cited

U.S. PATENT DOCUMENTS 4,297,135 10/1981 Giessen et al. ..... 75/129

*Primary Examiner*—John E. Kittle
*Assistant Examiner*—James J. Seidleck
*Attorney, Agent, or Firm*—J. Riesenfeld; Gerhard H. Fuchs

[57] ABSTRACT

The present invention is for a flat platelet powder for deposition onto a substrate. The powder is formed by fracture of brittle sheet or ribbon. The resulting powder has a faceted outline formed by fracture. The powder of the present invention produces a dense deposit.

3 Claims, No Drawings

PLATELET METAL POWDER FOR COATING A SUBSTRATE

This application is a division of application Ser. No. 285,885 filed July 22, 1981 abandoned.

FIELD OF THE INVENTION

The present invention relates to a powder for coating substrates, and more particularly to a platelet powder.

BACKGROUND ART

It has been the practice to deposit metal onto a substrate to form a coating, using such techniques as flame, and arc plasma spraying. The powders used to make coatings were globular or spheroidal. In general the powders used for arc plasma spraying were finer than those used for flame spraying.

U.S. Pat. No. 4,124,737 discloses powders whose shape and spraying characteristics are typical of the powders employed for arc plasma spraying. These powders were atomized and should have a spheriodal shape. All the powders used for arc plasma spraying are less than 325 Tyler mesh, or finer. These powders, produced a coating that was essentially lamellar, and composed of interlocking and overlapping microscopic leaves, these leaves being mechanically bonded to each other.

U.S. Pat. No. 4,192,672 discloses an atomized powder for spray-and-fuse use. The powder had Tyler mesh sizes generally greater than 100, and for many applications it is preferred that the powder be sufficiently fine to pass through a 270 Tyler sieve. While the deposits produced by the powders of the '672 patent were dense, the density was obtained by a secondary fushion step. If this secondary fusion step were omitted the deposit would show extensive porosity.

SUMMARY OF INVENTION

The powder of the present invention is a flat platelet powder suitable for coating a substrate. The powder can be formed by fracturing a brittle material in sheet or ribbon form. When so produced the powder will have an irregular faceted outline. The powders of the present invention can be effectively arc plasma sprayed when the particle size is as large as 80 Tyler sieve.

It is preferred that the oxygen content of the powders be less than 100 ppm.

Best Modes for Carrying the Invention into Practice

The platelet powders of the present invention have a shape which differs from the prior art spheroidal powders used for flame and arc plasma spraying. These platelet powders have a faceted outline formed by fracture. They were disclosed and claimed, for amorphous alloy powders, in the copending Ray application, U.S. application Ser. No. 023,411, filed Mar. 23, 1979, issued as U.S. Pat. No. 4,290,808 and assigned to the assignee of the present application. These platelet powders have several advantages over spheroidal powders. Spheroidal powders tend to settle and thus the size distribution will change with time, and movement of the containing vessel. The change in particle size distribution can produce different and upredictable flowing and coating characteristics.

The advantages of platelet powders with an irregular faceted outline are independent of microstructure (i.e. crystalline or non-crystalline). Furthermore, it has been found that coarser particles sizes can be used for deposition without any degradation in the character of the resulting deposit. It appears that platelet powders more effectively heat, since the aspect ratio will provide for a longer dwell time in the hot zone of the torch, and their greater surface to volume ratio will increase the heating rate of the powder. The platelet powders of the present invention appear to have aerodynamic properties which allow them to be readily fed into the torch.

The powders of the present invention can be produced with structures that are other than amorphous. The shape can be produced by fracturing any sheet of brittle material irrespective of whether the material is crystalline or amorphous.

It was appreciated that amorphous powders could be effectively compacted by Ray in the Ray Application, Ser. No. 023,411, issued as U.S. Pat. No. 4,290,808 assigned to the assignee of the present application, however, it was not known that the powders had unique properties which aided in their fluidization and that this particle shape made them particularly well suited for flame and/or arc plasma spraying.

The powders of the present invention have been demonstrated to freely flow when used for arc plasma spraying. The powders effectively deposit using blends with powders as large as 80 Tyler sieve.

It is further preferred that the oxygen content of the powders be held below 100 ppm. The oxygen content can be maintained at this low level by rapidly solidifying ribbon which is then pulverized to form powder. The ribbon may be heat treated or hydrided to embrittle before it is pulverized. Subsequent heat treatment may be employed to alter the microstructure of the powder.

In order to illustrate the merits of the powders of the present invention blends of powders having the size distribution given in Table I were prepared and arc plasma sprayed.

TABLE I

| | Distribution of Particle Size in Powders | |
|---|---|---|
| | Mesh Ranges | |
| BLEND | Particle Size Range Tyler sieve | Percentage of Powder within the Range |
| A | −80 to +100 | 15 |
| | −100 to +270 | 65 |
| | −270 to +325 | 15 |
| | −325 | 5 |
| B | −170 to +270 | 100 |
| C | −115 to +200 | 100 |

All the powders were produced by pulverizing rapidly solidified ribbon that was either amorphous or chemically homogeneous microcrystalline. The oxygen content of the powders produced by pulverizing rapidly solidified ribbon was typically less than 100 ppm.

EXAMPLE I

Powder blend A having a composition:

$Ni_{57.5}Fe_9Mo_{23.5}B_{10}$ by atomic percent was arc plasma sprayed onto a 4 in. by 4 in by 0.25 in. mild steel coupon. The coupon surface was blasted with No. 25 steel grit and subsequently cleaned using a degreasing solvent, 1,1-trichloroethane.

The powder was chemically homogeneous and microcrystalline as defined in the Kapoor, Wan, and Wang application U.S. application Ser. No. 220,618, filed Dec.

29, 1980, assigned to the assignee of the present application.

The powder was produced by fracturing ribbon in a jet mill. The fracture technique is further described in the copending Ray application, Ser. No. 022,411 issued as U.S. Pat. No. 4,290,808, assigned to the assignee of the present application.

The torch used to deposit the powder was an AVCO PG-100 with a 901065-1 anode.

The operating parameters for the torch were as follows:

Voltage: 29 volts
Amps: 860
Power: 25 kw
Carrier Gas and Flow rate: A, 8 cfm
Plasma Gases and Flow rate: A, 60 cfm, He, 15 cfm
Distance from torch to substrate: 6 inches The resulting deposit was 10 mils thick. The bond strength between the substrate and the deposit was 6900 psi. The deposit was sectioned and there was no indication of interconnected porosity. The coating had a density of 98%. The surface roughness of the deposit was less than 199 micro inches rms. The coating had a Vickers hardness of 1000 kg/mm$^2$ with a load of 100 grams.

EXAMPLE II

Powder blend A having a composition:

$Fe_{70}Cr_{10}Mo_{10}B_4C_6$ by atomic percent was arc plasma sprayed as set forth in Example I.

The powder of this example was amorphous and not microcrystalline.

The torch used to deposit the powder was the same as used in Example I, and the operating conditions were the same as for Example I.

The resulting tenacious deposit was 10 mils thick. The deposit was sectioned and there was no indication of interconnected porosity. The surface roughness was comparable to that of Example I. The hardness of the deposit was in excess of $R_c$ No. 70.

EXAMPLE III

Powder blend B having a composition:

$Ni_{57.5}Fe_9Mo_{23.5}B_{10}$ by atomic percent was deposited as set forth in Example I.

The torch used to deposit the powder was the same as used for Example I. The operating parameters were the same with the following exceptions:

Voltage: 27 volts
Amps: 575

The resulting deposit was 10 mils thick. The bond strength between the substrate and the deposit was 2400 psi. The deposit was sectioned and there was no indication of interconnected porosity. The density of the deposit was 91.5%. The surface roughness of the deposit was less than 235 micro inches RMS. The hardness was 1000 Kg/mm$^2$ Vickers with a load of 100 grams.

EXAMPLE IV

Powder blend C having a composition:

$Ni_{60}Mo_{30}B_{10}$ by atomic percent was arc plasma sprayed onto a 1.5 in. by 2.5 in. by 10 gauge mild steel coupon. The coupon surface was blasted with steel grit and degreased with trichloroethylene.

The torch used to deposit the powder was a Metco Gun, type 2MB, with an E type nozzle. The operating parameters were as follows:

Voltage: 70–80 volts
Amps: 400
Carrier Gas: He
Plasma Gas: $H_2$15 cfm, $N_2$100 cfm
Gas Pressure: 50 psi
Number of passes of torch: 4
Distance of torch from sample: 4–5 inches The resulting deposit was 12 mils thick. The deposit was sectioned and there was no indication of interconnected porosity. The density of the coating was 90 percent. The hardness of the surface was 1100 kg/mm$^2$ Vickers with a load of 100 grams.

It should be understood that for the above examples the powders were used to plasma arc spray, other coating techniques, such as flame spraying, vacuum arc plasma spraying, and laser glazing may be employed.

What is claimed is:

1. A method for depositing a coating free from interconnected porosity onto a substrate comprising:

(a) selecting an alloy based on Fe, Ni, Co or a combination thereof, said alloy being powder in platelet form, said powder being formed by fracturing of a brittle alloy and said powder having a particle size distribution such that at least 50% will not pass through a 270 Tyler mesh sieve and up to 15 percent will pass through an 80 Tyler mesh sieve but not through a 100 Tyler mesh sieve;

(b) processing said powder by passing it through a torch; and (c) depositing said processed powder onto a substrate.

2. The method of claim 1 wherein said torch is an arc plasma torch.

3. The method of claim 1 wherein said torch is a flame spray torch.

* * * * *